US010233692B2

(12) United States Patent
Kieffer et al.

(10) Patent No.: US 10,233,692 B2
(45) Date of Patent: Mar. 19, 2019

(54) FOLDABLE LADDER

(71) Applicant: Core Distribution, Inc., Minneapolis, MN (US)

(72) Inventors: Mitchell I. Kieffer, Minneapolis, MN (US); Nathan L. Schlueter, Bloomington, MN (US); Allen A. Caldwell, Savage, MN (US)

(73) Assignee: Core Distribution, Inc., Minneapolis, MN (US)

( * ) Notice: Subject to any disclaimer, the term of this patent is extended or adjusted under 35 U.S.C. 154(b) by 0 days.

(21) Appl. No.: 15/428,554

(22) Filed: Feb. 9, 2017

(65) Prior Publication Data

US 2017/0145745 A1 May 25, 2017

Related U.S. Application Data

(63) Continuation-in-part of application No. 14/557,944, filed on Dec. 2, 2014, now Pat. No. 9,580,959, and a
(Continued)

(51) Int. Cl.
*E06C 1/32* (2006.01)
*E06C 1/12* (2006.01)
(Continued)

(52) U.S. Cl.
CPC ..... *E06C 1/32* (2013.01); *E06C 1/125* (2013.01); *E06C 7/42* (2013.01); *E06C 7/082* (2013.01)

(58) Field of Classification Search
CPC ..... E06C 1/12; E06C 1/16; E06C 1/18; E06C 1/20; E06C 1/22; E06C 1/32; E06C 1/38;
(Continued)

(56) References Cited

U.S. PATENT DOCUMENTS 2,127,035 A * 8/1938 Kirlin ..... E06C 7/08 182/107
2,827,216 A * 3/1958 Napolitano ..... E06C 1/125 182/104
(Continued)

FOREIGN PATENT DOCUMENTS

CA 2157842 A1 3/1997
DE 20207715 U1 10/2003
(Continued)

OTHER PUBLICATIONS

Partial International Search for PCT/US2015/063518, dated Mar. 1, 2016, 4 pages.
(Continued)

*Primary Examiner* — Katherine W Mitchell
*Assistant Examiner* — Sherif M Mekhaeil
(74) *Attorney, Agent, or Firm* — Fredrikson & Byron, P.A.

(57) ABSTRACT

A foldable ladder has a first ladder portion and a second ladder portion hingedly attached to the first ladder portion by a pair of hinge mechanisms. Each hinge mechanism adapted to lock the first and second ladder portions such that the first ladder portion and the second ladder portion form an angle therebetween. The hinge mechanism has a locking pin to lock the first and second ladder portions at an angular position. Each rung is connected to a column by a connector assembly having first and second release buttons.

19 Claims, 13 Drawing Sheets

Related U.S. Application Data continuation of application No. PCT/US2015/063518, filed on Dec. 2, 2015.

(51) Int. Cl.
*E06C 7/42* (2006.01)
*E06C 7/08* (2006.01)

(58) Field of Classification Search
CPC ..... E06C 1/383; E06C 1/393; E06C 1/3835; E06C 7/082; E06C 7/00; E06C 9/082
USPC ..... 182/195
See application file for complete search history.

(56) References Cited

U.S. PATENT DOCUMENTS 3,643,292 A * 2/1972 Mayer ..... A47C 1/026 16/325
4,152,810 A * 5/1979 Martinez ..... E06C 1/32 16/325
4,182,431 A * 1/1980 Wing ..... E06C 1/12 182/167
4,376,470 A * 3/1983 Ashton ..... E06C 1/22 182/207
4,549,632 A * 10/1985 Inoue ..... E06C 1/383 182/160
4,566,150 A * 1/1986 Boothe ..... E05D 11/1007 16/332
4,770,559 A * 9/1988 Yoo ..... E06C 1/32 182/163
4,989,692 A 2/1991 Min
5,058,239 A * 10/1991 Lee ..... E06C 1/32 16/324
5,074,377 A * 12/1991 Krause ..... E06C 1/22 182/167
5,142,739 A * 9/1992 Lin ..... E05D 11/1007 16/324
5,620,272 A * 4/1997 Sheng ..... E05D 11/1007 182/163
5,738,186 A * 4/1998 Jones ..... E06C 1/125 182/195
5,775,460 A 7/1998 Stone
5,954,157 A * 9/1999 Grimes ..... E06C 1/12 16/329
5,992,566 A * 11/1999 Yeh ..... E06C 1/32 16/329
6,343,406 B1 * 2/2002 Yeh ..... E05D 11/1007 16/328
6,857,503 B2 2/2005 Simpson
6,883,645 B2 4/2005 Kieffer et al.
6,993,808 B1 * 2/2006 Bennett ..... A61F 5/0125 16/321
7,007,344 B2 * 3/2006 Lee ..... E05D 11/0054 16/231
7,047,597 B2 * 5/2006 Lee ..... E06C 1/32 16/233
7,140,072 B2 * 11/2006 Leng ..... E06C 1/32 16/326
7,306,075 B2 * 12/2007 Winslow ..... E06C 1/18 16/357
7,364,017 B2 * 4/2008 Moss ..... E06C 1/22 182/163
7,424,933 B2 * 9/2008 Weiss ..... E06C 1/32 16/328
8,104,580 B2 * 1/2012 Eriksson ..... E06C 1/125 182/195
8,348,015 B2 * 1/2013 Parker ..... E06C 1/125 182/195
8,381,873 B2 * 2/2013 Cross ..... E06C 1/39 182/119
8,387,753 B2 * 3/2013 Kieffer ..... E06C 7/088 182/195
8,591,444 B2 * 11/2013 Bejarano ..... A61F 5/0125 602/16
9,126,622 B2 * 9/2015 Hebenstreit ..... B62D 1/20
9,416,591 B2 8/2016 Kieffer et al.
2003/0012595 A1 * 1/2003 Park ..... E06C 1/32 403/84
2003/0062219 A1 * 4/2003 Yeh ..... E06C 1/32 182/163
2003/0127288 A1 * 7/2003 Ed ..... E06C 1/36 182/206
2003/0188923 A1 * 10/2003 Moss ..... E06C 1/32 182/23
2003/0217888 A1 * 11/2003 Simpson ..... E06C 1/18 182/23
2004/0020718 A1 * 2/2004 Kieffer ..... E06C 1/125 182/195
2004/0129497 A1 * 7/2004 Weiss ..... E06C 1/32 182/163
2005/0274571 A1 * 12/2005 Simpson ..... E06C 1/18 182/23
2006/0155230 A1 * 7/2006 Mason ..... A61F 5/0125 602/16
2006/0283664 A1 12/2006 Yao
2007/0067957 A1 * 3/2007 Moore ..... A61F 5/0125 16/326
2007/0201943 A1 * 8/2007 Yeh ..... E06C 1/32 403/100
2007/0267252 A1 11/2007 Yao et al.
2008/0000723 A1 * 1/2008 Kieffer ..... E06C 1/125 182/195
2008/0073150 A1 * 3/2008 Lin ..... E06C 1/32 182/163
2008/0109994 A1 * 5/2008 Liao ..... B62B 3/12 16/319
2009/0050407 A1 * 2/2009 Eriksson ..... E06C 1/125 182/195
2009/0078503 A1 3/2009 Eriksson
2010/0258379 A1 * 10/2010 Mickens ..... B60R 3/00 182/111
2011/0056764 A1 * 3/2011 Cross ..... E06C 1/32 182/27
2012/0267197 A1 * 10/2012 Kieffer ..... E06C 1/125 182/194
2015/0204138 A1 7/2015 Weston
2015/0315844 A1 * 11/2015 Miao ..... E06C 7/50 16/319

FOREIGN PATENT DOCUMENTS

DE 202013009466 U1 11/2013
JP 2010024799 A 2/2010
WO 2004044365 A2 5/2004
WO 2005045172 A1 5/2005
WO 2009057995 A1 5/2009

OTHER PUBLICATIONS

International Patent Application No. PCT/US2015/063518, International Search Report and Written Opinion dated May 10, 2016, 22 pages.

* cited by examiner

FOLDABLE LADDER

CROSS REFERENCES

This application is a continuation-in-part of U.S. application Ser. No. 14/557,944, filed Dec. 2, 2014, and is a continuation of PCT application PCT/US15/63518, filed Dec. 2, 2015, the contents of each of which are hereby incorporated by reference in its entirety.

BACKGROUND

Ladders typically include rungs supported between stiles formed from a plurality of columns. In some cases, the ladder can be a telescoping ladder and can be expanded to separate the columns from one another for extension of the ladder, or collapsed together for retraction of the ladder. Such ladders often include mechanisms which can allow the ladder to be folded for storage and unfolded during use.

SUMMARY OF THE INVENTION

Certain embodiments of the invention include a foldable ladder comprising a first ladder portion and a second ladder portion hingedly attached about a hinge axis to the first ladder portion by a pair of hinge mechanisms. Each hinge mechanism can lock the first and second ladder portions such that the first ladder portion and the second ladder portion form an angle therebetween. Each hinge mechanism has a shifting mechanism, comprising a shift pattern defined by a plurality of slots, each corresponding to an angular position of the first ladder portion with respect to the second ladder portion. The shifting mechanism comprises a selector pin that can be shifted in the shift pattern and received by a slot to lock the second ladder portion at an angular position with respect to the first ladder portion.

In certain embodiments, the hinge mechanism comprises a locking pin moveable along its central axis radially away from and towards the hinge axis. The locking pin can be spring biased radially towards the hinge axis and rotatable about its central axis. The hinge mechanism comprises a plurality of recesses each directed radially inward towards the hinge axis from the end of a hinge member. The plurality of recesses can be spaced angularly about the hinge axis, wherein the angular position about the hinge axis of each recess corresponding to a predetermined angle between the first and second ladder portions. In such embodiments, each recess has a corresponding ladder angle opening having an opening shape. The opening shape can permit insertion of the locking pin therethrough when locking pin is rotated about its central axis to a rotation where the orientation of the locking pin cross-section generally matches the opening shape. The opening shape can block insertion of the locking pin therethrough when locking pin is rotated about its central axis to a rotation where the orientation of the locking pin cross-section does not generally match the opening shape.

Certain embodiments include a method of folding a ladder. The method can comprise the step of providing a foldable ladder, moving the selector pin away from a first slot to release the first and second ladder portions from a first angular position, shifting the selector pin in the shift pattern and proximal to a second slot, hingedly rotating one of the first and second ladder portions about the hinge axis to a second angular position, and securing the selector pin in the second slot and correspondingly securing the locking pin in a recess to the lock the first and second ladder portions at the second angular position.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1A:
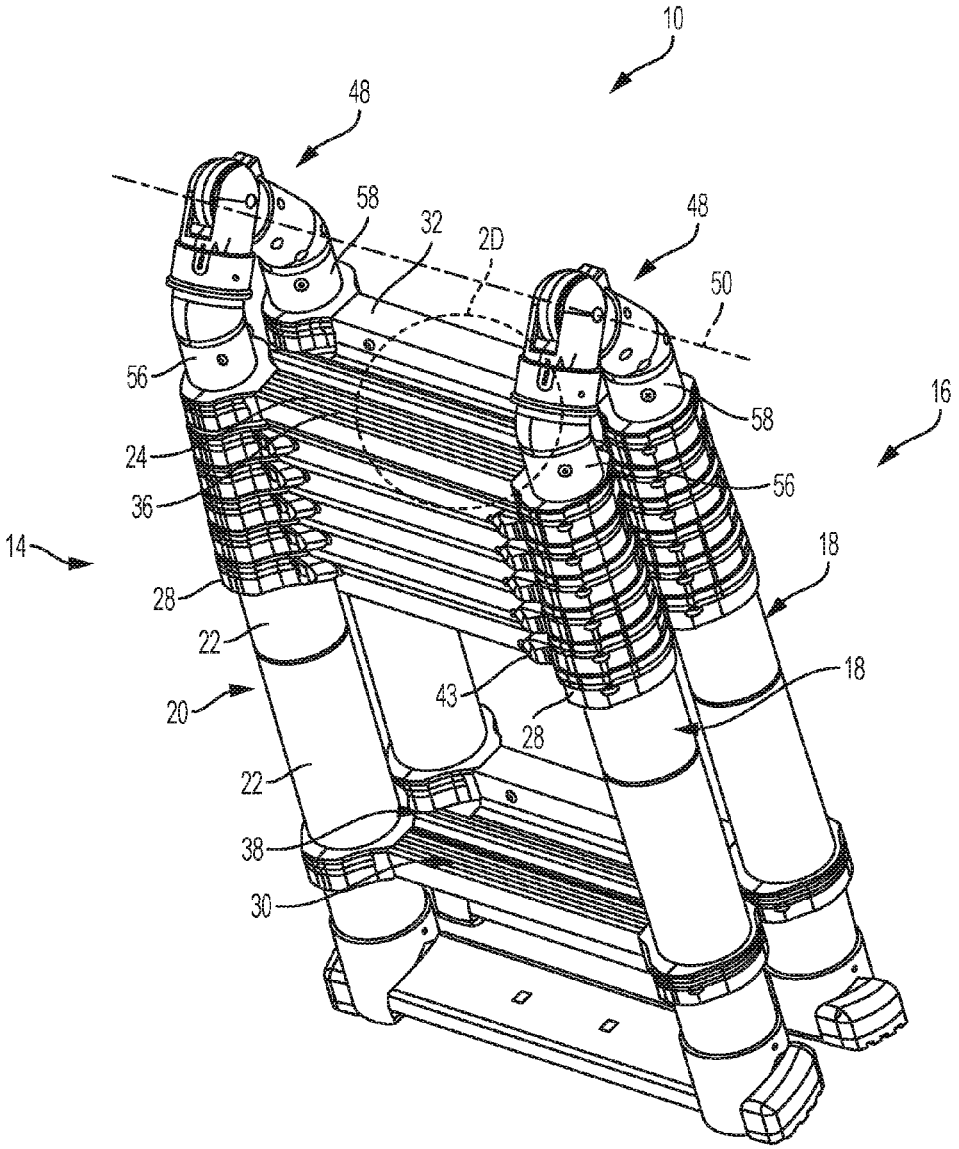
FIG. 1A is a perspective view of a foldable ladder locked at a first angular position according to an embodiment.
Figure 1B:
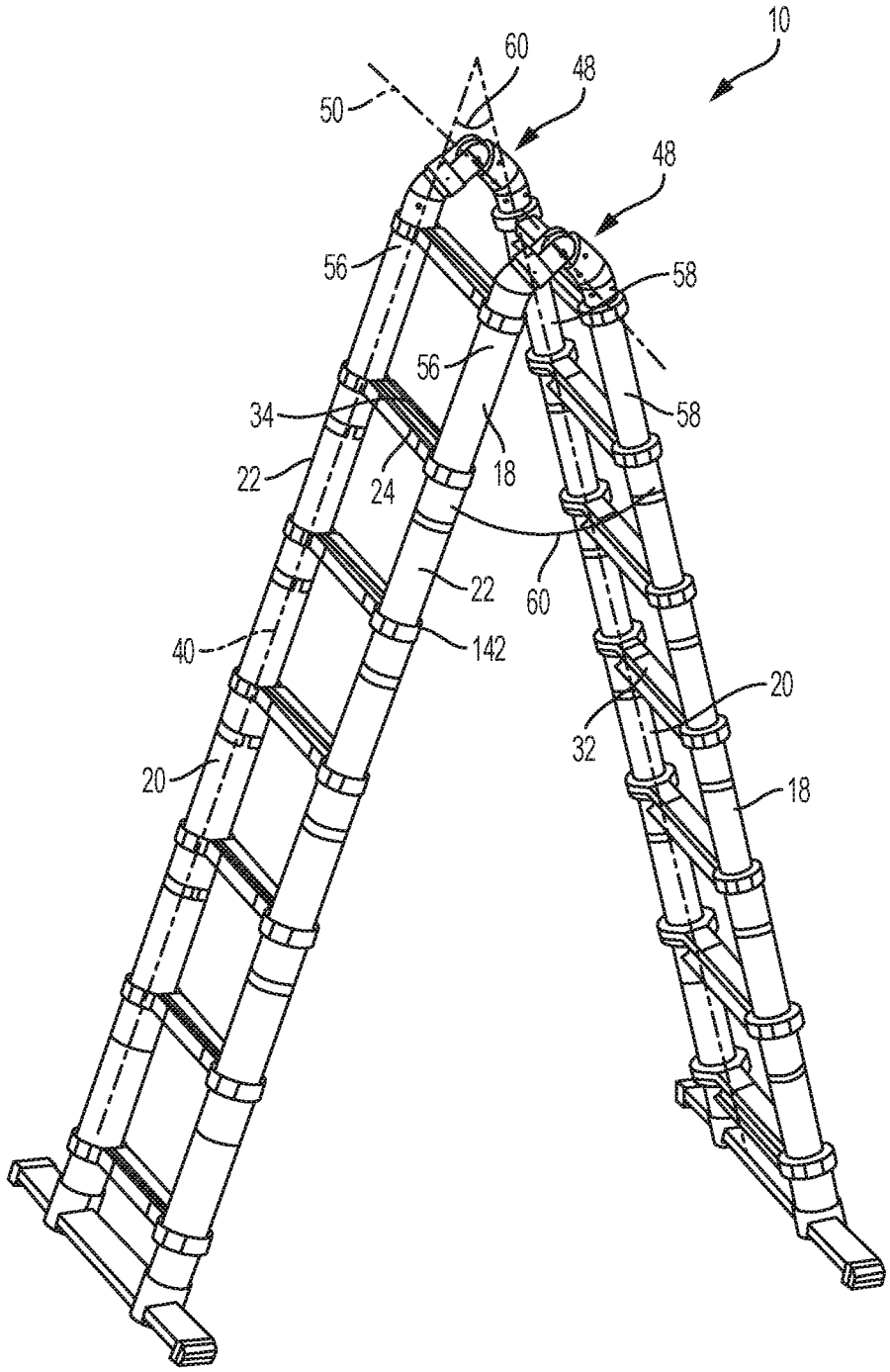
FIG. 1B is a perspective view of the foldable ladder of FIG. 1A locked at a second angular position.
Figure 2A:
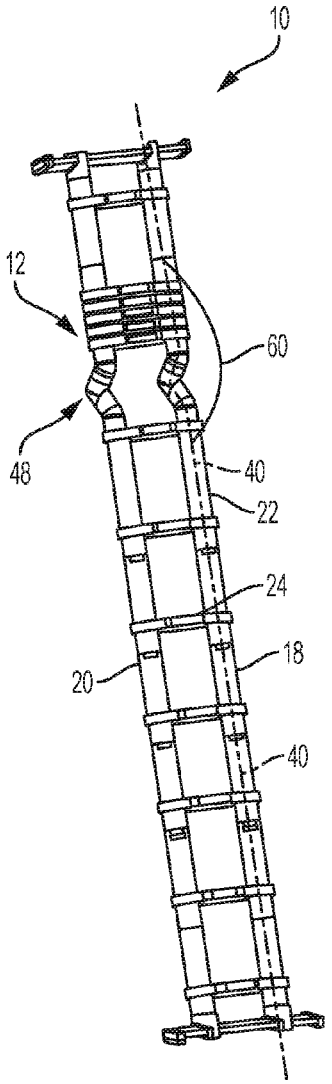
FIG. 2A is a perspective view of the foldable ladder of FIG. 1A locked at a third angular position shown in a collapsed state.
Figure 2B:
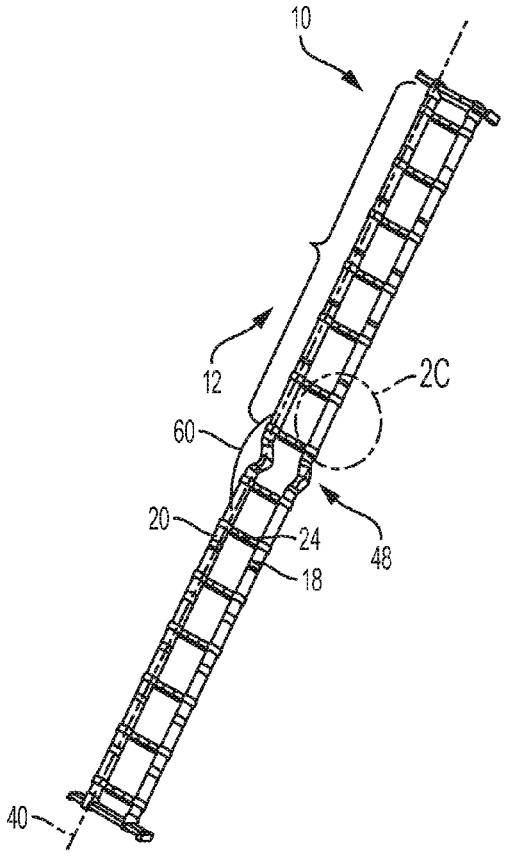
FIG. 2B is a perspective view of the foldable ladder of FIG. 2A shown in an extended state.

FIG. 1A is a front perspective view of a ladder 10 according to some embodiments. FIGS. 1B, 2A and 2B are front perspective views of a ladder 10 unfolded from its folded position illustrated in FIG. 1 and locked at various angles, according to some embodiments. In FIG. 1B, the ladder 10 has been unfolded from its folded position in FIG. 1A and locked at an angle 60 of about 30 degrees. In FIGS. 2A and 2B, the ladder 10 has been locked at an angle 60 of about 180 degrees. In FIG. 2A, an upper portion 12 of the ladder 10 is in a collapsed/retracted state, whereas in FIG. 2B, the upper portion 12 of the ladder 10 is in an extended state. The ladder 10 illustrated in these views can have a first ladder portion 14 and a second ladder portion 16, each including two opposing stiles, a left side stile 18 and a right side stile 20, each formed by a plurality of columns 22. According to the illustrated embodiment each opposing column of each stile includes a rung 24 extending therebetween, wherein each rung 24 is coupled on either end to an opposing column by a connector assembly 28. In some embodiments, the columns 22 are formed of aluminum. Other materials are contemplated and are within the scope of the invention. The columns 22 are illustrated as having a circular cross-section (when viewed along the longitudinal axis 40 of the columns 22), the columns 22 can have a rectangular cross-section such as those illustrated in U.S. Publication No. 2012/0267197 A1 assigned to the assignee of the instant application, the disclosure of which is hereby incorporated by reference in its entirety. Other cross-sections (e.g., square, oval or polygonal shapes) are also contemplated. As will be described herein, in some embodiments, the columns 22 can be substantially hollow so as to allow a connector assembly 28 to fasten the rung 24 to a column on each of the right side and left side stiles 20, 18.

Figure 2C:
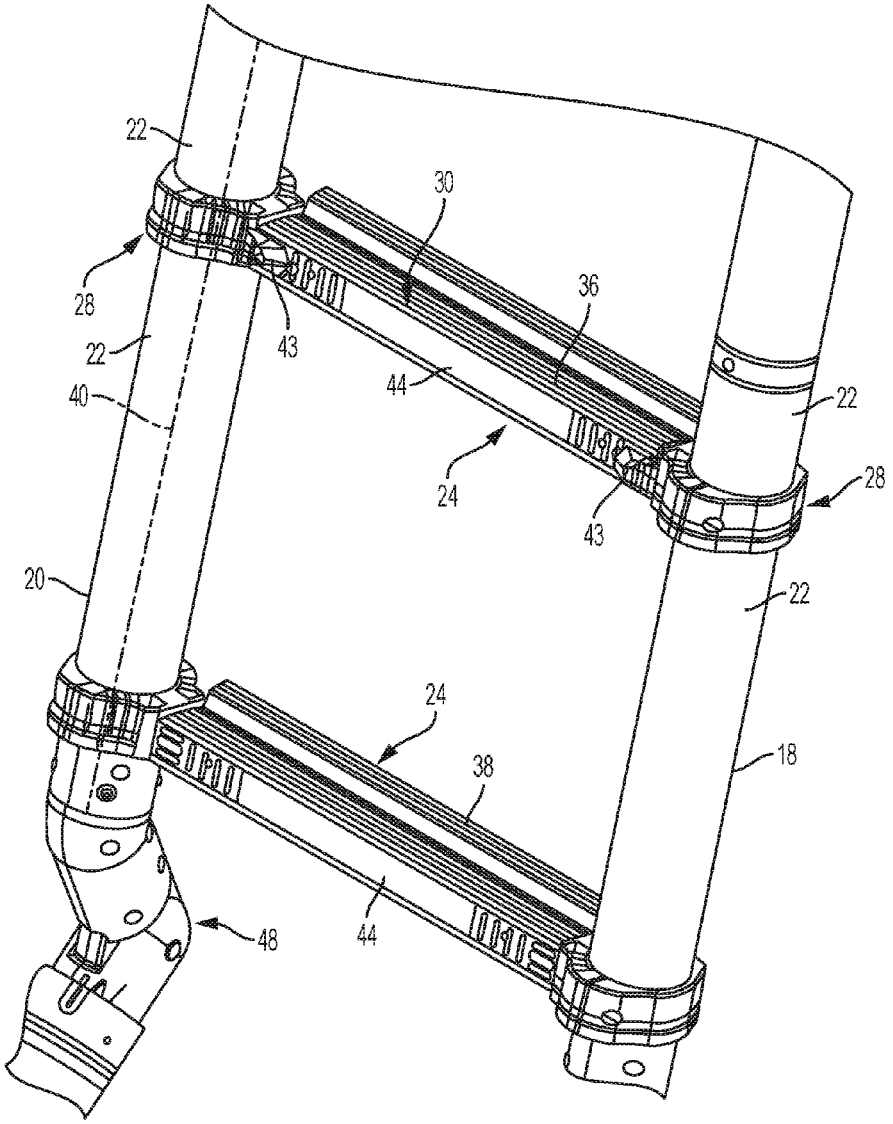
FIG. 2C is a close-up perspective view of portion "2C" of FIG. 2B.
Figure 2D:
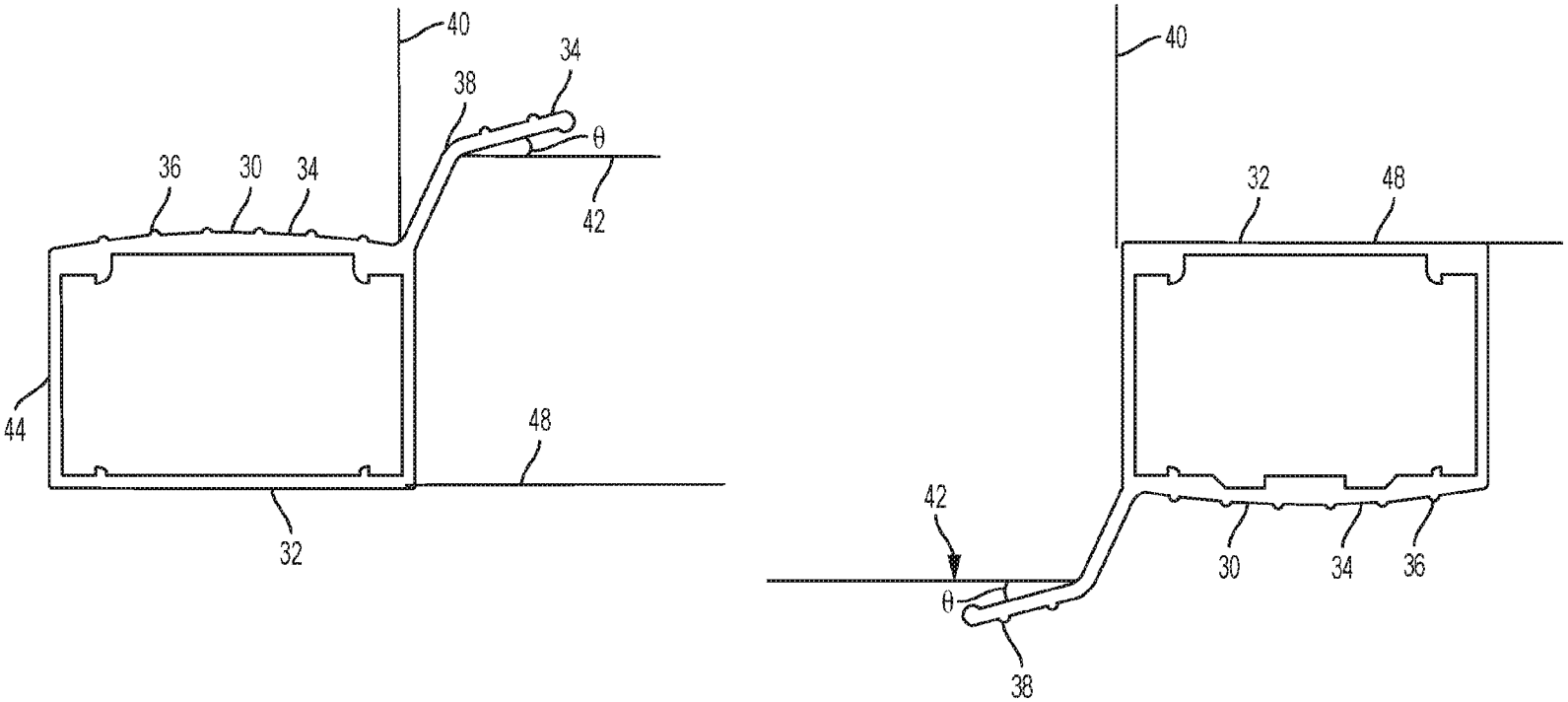
FIG. 2D is a left side view of the foldable ladder of portion "2D" of FIG. 1A showing only the rungs of the first and second ladder portion.

FIG. 2C illustrates a close-up perspective view of a rung 24 of the first ladder portion 14. FIG. 2D illustrates a side view showing a rung 24 of the first ladder portion 14 and a rung 24 of the second ladder portion 16 when the ladder 10 is folded as shown in FIG. 14. In some embodiments, each rung 24 comprises a planar first surface 30 and a planar second surface 32 opposite to the planar first surface 30. The first surface 30 of each rung 24 of the first ladder portion 14 defines a planar standing surface 34. At least one of the planar first and second surfaces of the second ladder portion 16 defines a planar standing surface 34. Referring back to FIGS. 2A-2B, when the ladder 10 is unfolded for use, the first surface 30 of each rung 24 of the second ladder portion 16 has a planar standing surface 34 as shown by the close-up view of FIG. 2C. However, when ladder 10 is folded for storage or unfolded to angles other than about 180 degrees (e.g., as shown in FIG. 1B), the first surface 30 of each rung 24 of the second ladder portion 16 may not face the top and therefore the planar standing surface 34 may be defined on the underside of the rung 24 when the ladder 10 is folded for storage or unfolded to angles other than 180 degrees. The planar standing surface 34 of each rung 24 of the first and second ladder portions 14, 16 may have treads 36 defined therein to provide friction between the planar standing surface 34 and the contact surface of a user (e.g., soles of the user's shoes). As will be described herein, the rungs can be substantially hollow so as to allow a connector assembly 28 to fasten the rung 24 to a column on each of the right side stile 20 and left side stile 18. The rungs can be extruded from aluminum, although other materials and means of manufacturing can also be used.

While FIGS. 2C and 2D illustrate a rung 24 with a substantially rectangular cross-section, other cross-sectional shapes of the rung 24 are also contemplated. For instance, the rung 24 can have a parallelogram cross-section such as those illustrated in U.S. Publication No. 2012/0267197 A1, assigned to the assignee of the instant application, the disclosure of which is hereby incorporated by reference in its entirety. While the illustrated FIGS. 2C and 2D show a substantially rectangular rung 24, at least a portion of the first surface 30 of the first and second ladder portions 14, 16 forms an angle 60 with respect to a horizontal plane 42. In the illustrated embodiment, when the angled portions of the first surface 30 form an angle θ with respect to the horizontal plane 42. The angle θ can be between about 5 degrees and 45 degrees (e.g., between 5 degrees and 20 degrees). Such embodiments allow at least the angled portion 38 of the first surface 30 of the ladder 10 to be horizontal when the ladder 10 is rotated towards a vertical wall (e.g., propped against a wall at an angle) so that during normal use, at least a portion of the vertical wall can be nearly horizontal. However, depending on the angle at which the ladder 10 is propped against a vertical wall, the angled portion 38 may be past or short of being horizontal.

Referring back to FIG. 2C, each rung 24 is connected to a column of the plurality of columns 22 by a connector assembly 28. In some cases, the plurality of columns 22 are disposed in a nested arrangement for relative axial movement in a telescopic fashion such that the ladder 10 is extendable or collapsible along the longitudinal axis 40 of the columns 22. Such telescoping ladders and various types of connector assemblies are described in detail in U.S. Pat. No. 8,387,753 B2 and U.S. Pat. No. 6,883,645 B2, both assigned to the assignee of the instant application, the disclosure of each of which is hereby incorporated by reference in its entirety. In such telescoping ladders, the connector assembly 28 includes a release button 43 slidable along a front surface 44 of the rung 24 to unlock or selectively lock the relative axial movement between two adjacent columns 22 of the plurality of columns 22, the front surface 44 of the rung 24 being generally perpendicular to a plane 46 normal to the longitudinal axis 40 of the plurality of columns 22.

Figure 2E:
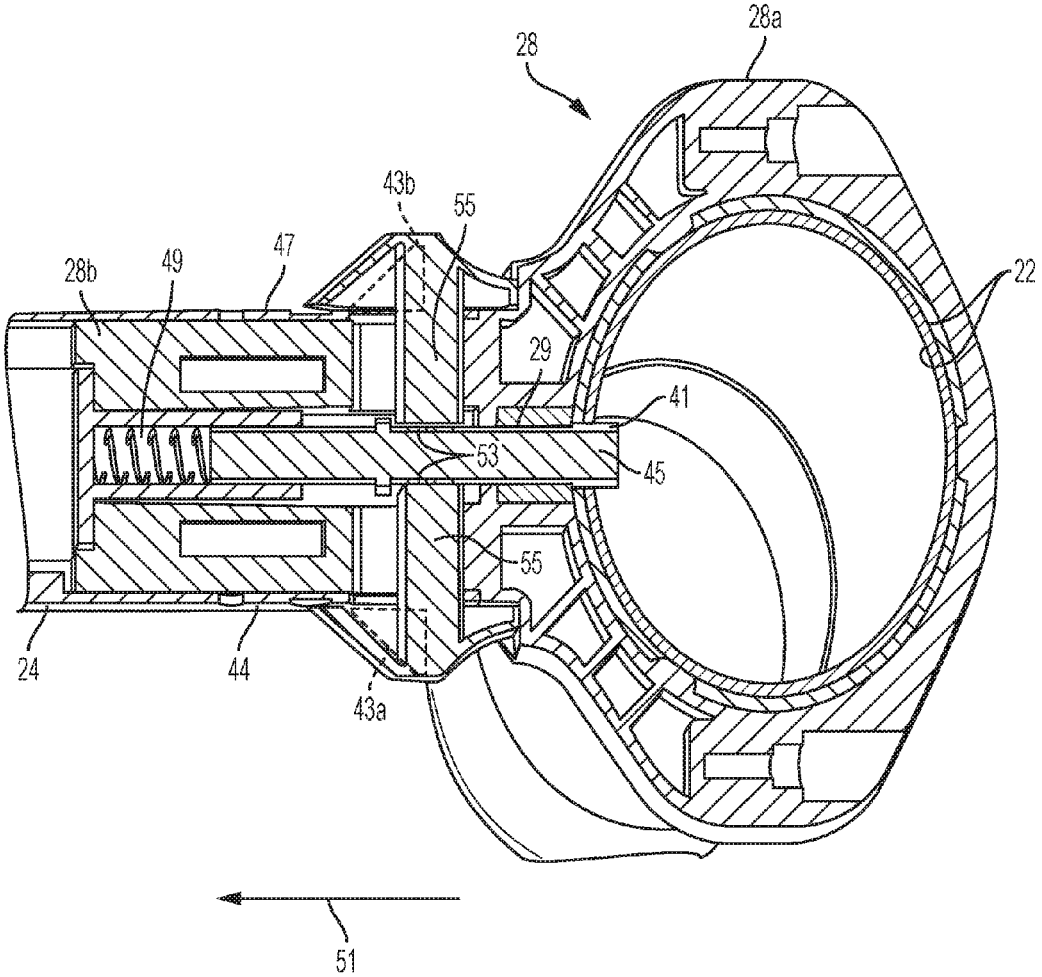
FIG. 2E is a sectional plan view of a portion of the ladder showing details of a connector assembly according to an embodiment.

FIG. 2E illustrates a sectional top view of a portion of the ladder according to some embodiments, taken along a plane parallel to the top surface of a rung, illustrating details of the connector assembly 28. The sectional view of FIG. 2E is representative of most, if not all rungs of the ladder with a connector assembly 28. The connector assembly comprises a collar portion 28*a* surrounding the columns 22 and in contact with the perimeter surface of an outer column, and a rung portion 28*b* inserted into a rung 24. In the embodiment shown in FIG. 2E, the connector assembly 28 includes a latch mechanism housed in the rung portion 28*b* including two release buttons 43*a* and 43*b* and a pin 45. Release button 43*a* is slidable along the front surface 44 of the rung, and release button 43*b* is slidable along the back surface 47 of the rung 24.

In the embodiment of FIG. 2E, the pin 45 is disposed in an extended position in which pin 45 extends into an aperture 29 defined on the connector assembly 28 and into openings 41 on the columns 22. In some embodiments of the present invention, pin 45 is biased (e.g., by spring 49) to assume the extended position. When this is the case, pin 45 may be selectively urged to assume a retracted position by applying sliding either button 43*a* or button 43*b* in a direction 51. According to the illustrated embodiment, the pin 45 includes one or more through-holes 53 through which the shanks 55 of each button 43*a*, 43*b* can be inserted (e.g., by a friction fit) for coupling the buttons 43*a*, 43*b* to the pin 45 in a cooperative fashion. As is apparent from FIG. 2E, the pin 45 may be retracted or extended by sliding either the button 43*a* or button 43*b* along the respective surface 44 or 47 in the direction 51 as illustrated. The sliding movement of either button would also slide the other button in the direction 51 because of the cooperative connection therebetween via the pin 45. In some cases, each rung 24 of the first ladder portion 14 and the second ladder portion 16 may have a button slidable on the front surface 44 and a button slidable on the back surface 47 as illustrated. Alternatively, any one ladder portion (first ladder portion 14, or second ladder portion 16) can have buttons on one or both the front surface 44 and the back surface 47.

FIG. 2E illustrates a sectional top view of a portion of the ladder according to some embodiments, taken along a plane parallel to the top surface of a rung, illustrating details of the connector assembly 28. The sectional view of FIG. 2E is representative of all rungs of the ladder with a connector assembly 28. The connector assembly comprises a collar portion 28*a* surrounding the columns 22 and in contact with the perimeter surface of an outer column, and a rung portion 28*b* inserted into a rung 24. In the embodiment shown in FIG. 2E, the connector assembly 28 includes a latch mechanism housed in the rung portion 28*b* including two release buttons 43*a* and 43*b* and a pin 45. Release button 43*a* is slidable along the front surface 44 of the rung, and release button 43*b* is slidable along the back surface 47 of the rung 24. In the embodiment of FIG. 2E, the pin 45 is disposed in an extended position in which pin 45 extends into an aperture 29 defined on the connector assembly 28 and into openings 41 on the columns 22. In some embodiments of the present invention, pin 45 is biased (e.g., by spring 49) to assume the extended position. When this is the case, pin 45 may be selectively urged to assume a retracted position by applying sliding either button 43*a* or button 43*b* in a direction 51. According to the illustrated embodiment, the pin 45 includes one or more through-holes 53 through which the shanks 55 of each button 43*a*, 43*b* can be inserted (e.g., by a friction fit) for coupling the buttons 43*a*, 43*b* to the pin 45 in a cooperative fashion. As is apparent from FIG. 2E, the pin 45 may be retracted or extended by sliding either the button 43*a* or button 43*b* along the respective surface 44 or 47 in the direction 51 as illustrated. The sliding movement of either button would also slide the other button in the direction 51 because of the cooperative connection therebetween via the pin 45. In some cases, each rung 24 of the first ladder portion 14 and the second ladder portion 16 may have a button slidable on the front surface 44 and a button slidable on the back surface 47 as illustrated. Alternatively, any one ladder portion (first ladder portion 14, or second ladder portion 16) can have buttons on both the front surface 44 and the back surface 47.

Figure 3:
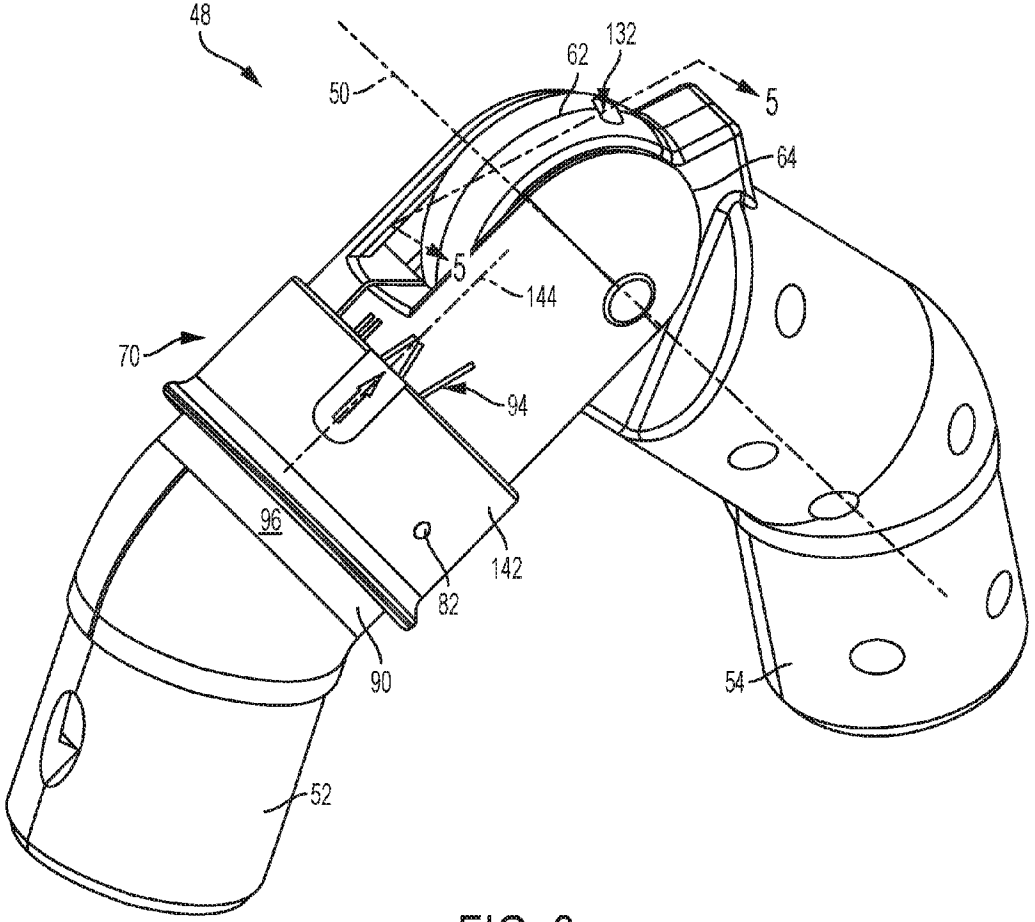
FIG. 3 is a perspective view of a hinge mechanism according to an embodiment.
Figure 4A:
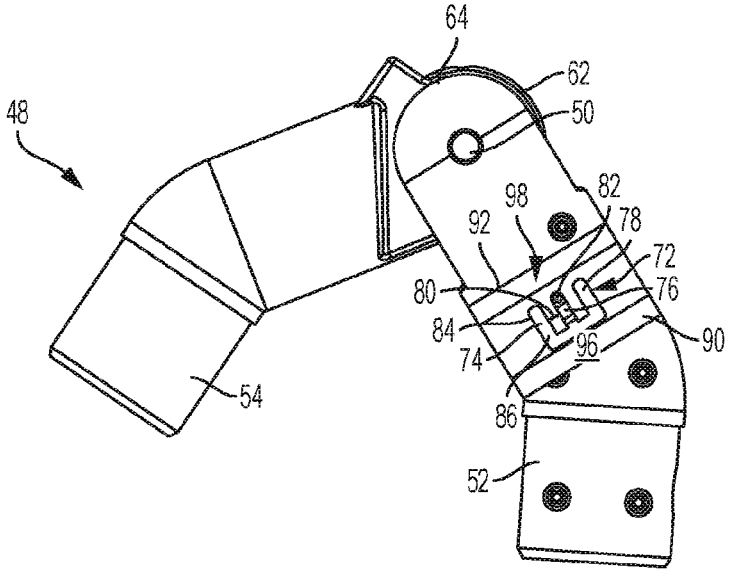
FIG. 4A is a side view of the hinge mechanism of FIG. 3 with the selection collar removed from view for showing certain details of the hinge mechanism.
Figure 4B:
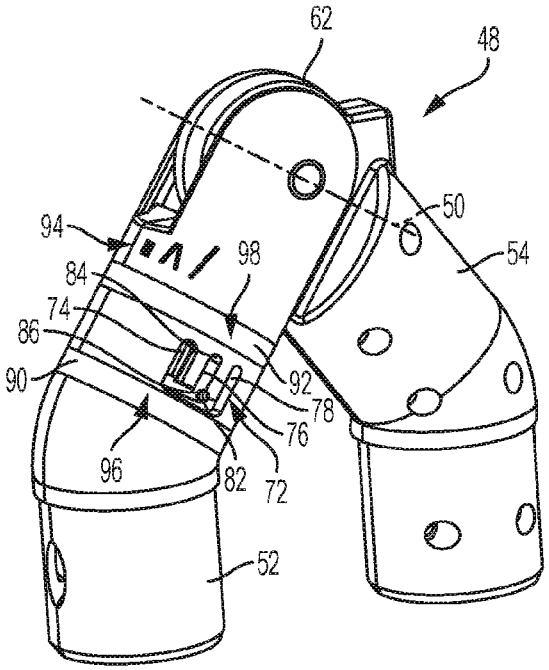
FIG. 4B is a side perspective view of the hinge mechanism of FIG. 3 shown in an unlocked state with the selection collar removed from view for showing certain details of the hinge mechanism.

Referring back to FIG. 1A, the foldable ladder 10 comprises a pair of hinge mechanisms hingedly connecting the first ladder portion 14 to the second ladder portion 16. FIG. 3 illustrates a perspective view of a hinge mechanism 48 and FIGS. 4A-4B illustrate various detailed views of the hinge mechanism 48 according to certain embodiments of the invention. As seen in FIGS. 1A-2B and FIG. 3, the hinge mechanism 48 can fold the first and second ladder portions 14, 16 about a hinge axis 50. The hinge mechanism 48 can lock the first and second ladder portions 14, 16 such that the first ladder portion 14 and the second ladder portion 16 form an angle 60 therebetween. As best seen in FIG. 1B, the angle 60 can be defined as the angle between the longitudinal axis 40 of the columns 22 of the first ladder portion 14 and the longitudinal axis 40 of the columns 22 of the second ladder portion 16. In FIG. 1A, the first and second ladder portions 14, 16 form an angle 60 of about 0 degrees. In FIG. 1B, the first and second ladder portions 14, 16 form an angle 60 of about 30 degrees. In FIGS. 2A-2B, the first and second ladder portions 14, 16 form an angle 60 of about 180 degrees.

Figure 4C:
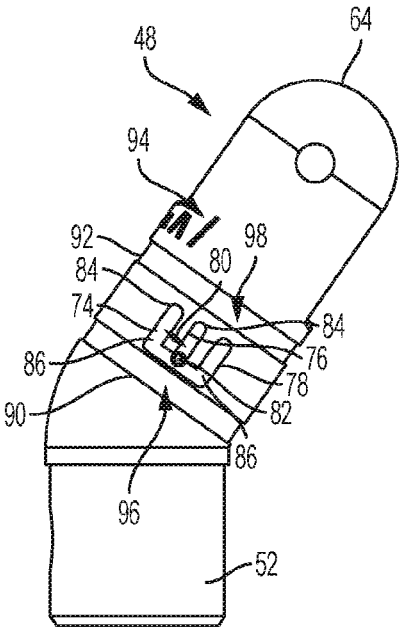
FIG. 4C is a side view of the hinge mechanism shown in FIG. 4B with the second hinge member and the selection collar removed from view for showing certain details of the hinge mechanism.

Referring now to FIGS. 4A-4C, each hinge mechanism 48 comprises a first hinge member 52 connectable to the first ladder portion 14 and a second hinge member 54 connectable to the second ladder portion 16. As seen in FIG. 1B, the first hinge member 52 can be connected coaxially with the longitudinal axis 40 of the columns 22 of the first ladder portion 14, and the second hinge member 54 can be connected coaxially with the longitudinal axis 40 of the columns 22 of the second ladder portion 16. For instance, as seen in FIG. 1A, the first hinge members 52 of the left and right side hinge mechanisms are both connected to the top most columns 56 (left and right side columns 56) of the first ladder portion 14, and the second hinge members 54 of the left and right side hinge mechanisms are both connected to the top most columns 58 (left and right side columns 58) of the second ladder portion 16. The hinge mechanisms on the left and right side shown in FIG. 1A can be substantially similar. Alternatively, the hinge mechanism 48 on the right side can be a mirror image of the hinge mechanism 48 on the left side. The first and second hinge members 52, 54 are rotatable with respect to each other about the hinge axis 50. As the first and second hinge members 52, 54 are rigidly coupled to the first and second ladder portions 14, 16, rotation of the first and second hinge members 52, 54 rotate the first and second ladder portions 14, 16 with respect to each other and vice versa. The rotation of the first and second ladder portions 14, 16 is about the hinge axis 50 such that the first and second ladder portions 14, 16, and the first and second hinge members 52, 54 when rotated, form an angle 60 therebetween. At least a portion of an edge 62 of the second hinge member 54 can be semi-circular. Additionally, at least a portion of an edge 64 of the first hinge member 52 can be semi-circular. Other shapes of the portion of the edges 62, 64 are also contemplated, such as semi-elliptical or other arcuate shapes.

With continued reference to FIGS. 3 and 4A-4C, the hinge mechanism 48 comprises a shifting mechanism 70. The shifting mechanism 70 can act as a selector and allow a user to select the angle 60 between the first and second ladder portions 14, 16. The shifting mechanism 70 comprises a shift pattern 72 defined by a plurality of slots 74, 76, 78 positioned peripherally on the first hinge member 52. Each slot 74, 76, 78 corresponds to an angular position of the first ladder portion 14 with respect to the second ladder portion 16, and adjacent slots 74, 76, 78 are separated by a distance 80 defined along a perimeter of the first hinge member 52. As best seen in FIG. 4A, a selector pin 82 can be shifted in the shift pattern 72 and received by a slot 74, 76, 78 at a first end 84 of the slot 74, 76, 78 to lock the second ladder portion 16 at an angular position with respect to the first ladder portion 14. In the illustrated embodiments shown in FIGS. 4A and 4B, the shifting mechanisms comprises three slots 74, 76, 78 corresponding to three angular positions at which the first and second ladder portions 14, 16 can be positioned. As shown in FIG. 4C, the selector pin 82 can be released from the first end 84 and moved proximal to the second end 86 to release the first and second ladder portions 14, 16 from their locked position. Once released, the first and second ladder portions 14, 16 can be rotated with respect to each other to change the angle 60 between them.

As seen in FIGS. 4A-4C, the hinge mechanism 48 includes one or more safety indicators. The safety indicators can be a visual indicator such as indicia or color-coded bands to indicate whether the first and second ladder portions 14, 16 are locked in an angular position. The safety indicators can be audible "click" or a tactile indicator to provide auditory or tactile feedback to the user to indicate that the first and second ladder portions 14, 16 are locked securely in an angular position. In the embodiments illustrated in FIG. 4A, the safety indicators provide a first visual indication 90 (e.g., a green colored strip or zone, or other indicia in a first region 96) when the first and second ladder portions 14, 16 are locked at an angular position. In the embodiment illustrated in FIGS. 4B and 4C, the safety indicators provide a second visual indication 92 (e.g., a red colored strip or zone or other indicia placed in a second region 98) when the first and second ladder portions 14, 16 are unlocked. Additionally the ladder 10 can include other indicia (e.g., alphanumeric characters, images, symbols etc.) to indicate the predetermined angles at which the first and second ladder portions 14, 16 can be positioned. For instance, in the embodiment illustrated in FIG. 4B, the three indicia 94 are symbolic representations of the angular positions of the ladder 10 indicating that the first and second ladder portions 14, 16 can be locked at about 0 degrees, about 30 degrees, and about 180 degrees. Such indicia 94 can also be positioned proximal to each slot 74, 76, 78 to provide information to the user as to by what rotational angle 60 the first and second ladder portions 14, 16 are to be rotated when the selector pin 82 is positioned proximal to (e.g., at or near the second end 86 of) each slot 74, 76, 78.

Figure 5:
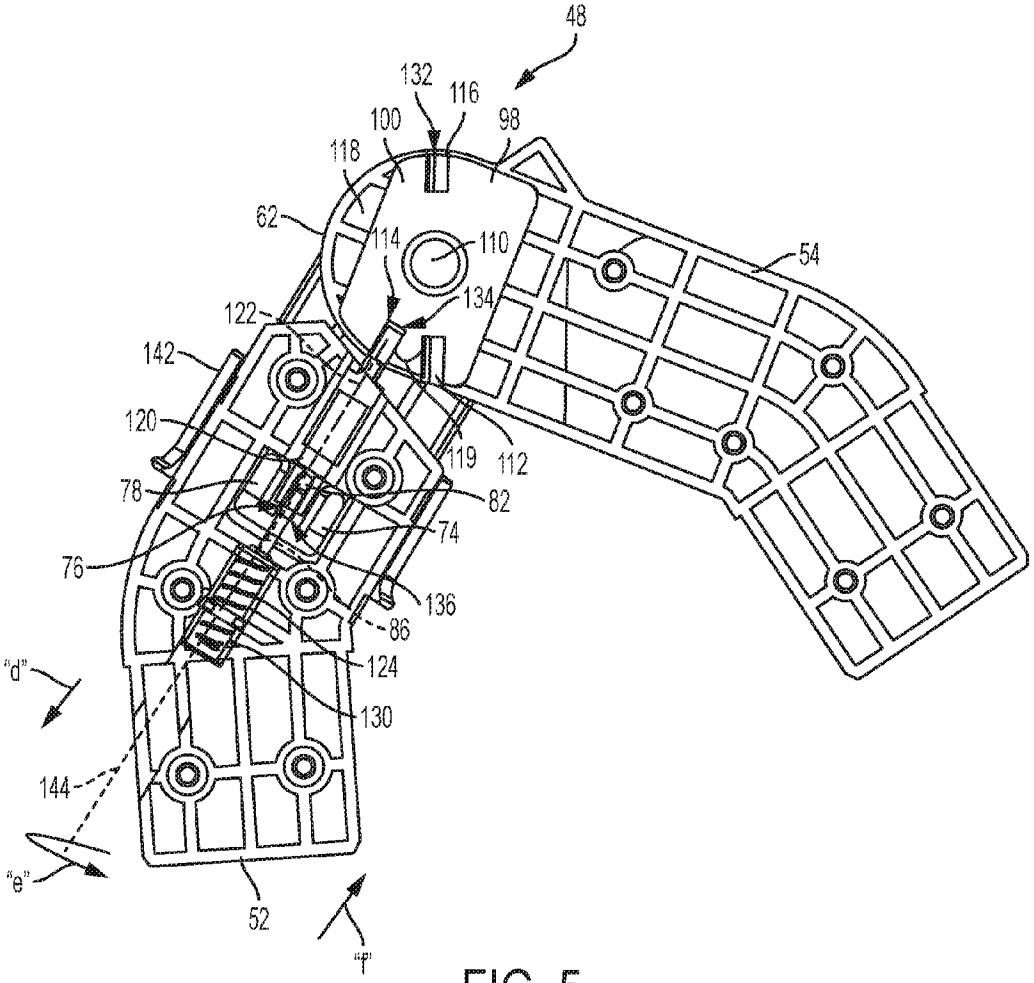
FIG. 5 is a cross-sectional view of the hinge mechanism taken along the line 5-5 shown in FIG. 3.

Referring now to FIG. 5, in some embodiments, the hinge mechanism 48 comprises a locking plate 100 positioned in the second hinge member 54 such that a center 110 of the locking plate 100 is concentric with the hinge axis 50. As seen from the cross-sectional view of FIG. 5, the locking plate 100 can be bolted to the second hinge member 54 such that the hinge axis 50 coincides with the center 110 of the locking plate 100. Alternatively, the locking plate 100 can be connected to the second hinge member 54 such that it forms a frictional fit with the inner surfaces (e.g., ribs) of the second hinge member 54 such that the center 110 of the locking plate 100 is concentric with the hinge axis 50. When coupled in this manner, the locking plate 100 is fixedly positioned in the second hinge member 54 and does not move or rotate relative to the second hinge member 54.

With continued reference to FIG. 5, the locking plate 100 comprises a plurality of recesses 112, 114, 116. Each recess extends radially inwardly from an outer edge 118 of the locking plate 100 and toward the center 110 of the locking plate 100. The recesses 112, 114, 116 are each therefore directed radially inward towards the hinge axis 50 from an end of the second hinge member 54 due to the concentric positioning of the center 110 of the locking plate 100 and the hinge axis 50. The recesses 112, 114, 116 are spaced angularly about the hinge axis 50 such that the angular position of each recess about the hinge axis 50 corresponds to a predetermined angle 60 between the first and second ladder portions 14, 16. At this position, the selector pin 84 is received in a slot 74, 76, 78. For instance, in an exemplary embodiment, each recess can be separated from another recess by an angle 119 corresponding to the angle 60 between the first and second ladder portions 14, 16. In such cases, the number of recesses 112, 114, 116 corresponds to the number of positions at which the first and second ladder portions 14, 16 are lockable. In the illustrated embodiment, the locking plate 100 includes three recesses 112, 114, 116: a first recess 112, a second recess 114 and a third recess 116. The first and second ladder portions 14, 16 can be therefore locked at three angular positions, corresponding to an angle 119 between each of the recesses 112, 114, 116. In operation, the first and second ladder portions 14, 16 can be rotated by an angle 60 corresponding to the angle 119 between two recesses (e.g., 112 and 114, or 112 and 116) and locked therein. As described above, the angle 60 between the first and second ladder portions 14, 16 can be between about 0 degrees and about 180 degrees. For instance, the locking plate 100 in the illustrated embodiment includes three recesses 112, 114, 116 and the first and second ladder portions 14, 16 are lockable at a first angular position, a second angular position and a third angular position at angles of about 0 degrees, about 30 degrees and about 180 degrees respectively. Accordingly, in the illustrated embodiments shown in FIG. 5, the angle 119 between the first recess 112 and the second recess 114 is about 30 degrees, and the angle 119 between the first recess 112 and the third recess 116 is about 180 degrees. Additional recesses corresponding to additional lockable configurations of the first and second ladder portions 14, 16 (e.g., at about 45 degrees, about 60 degrees, about 120 degrees or other additional angles) are also contemplated.

Figure 6:
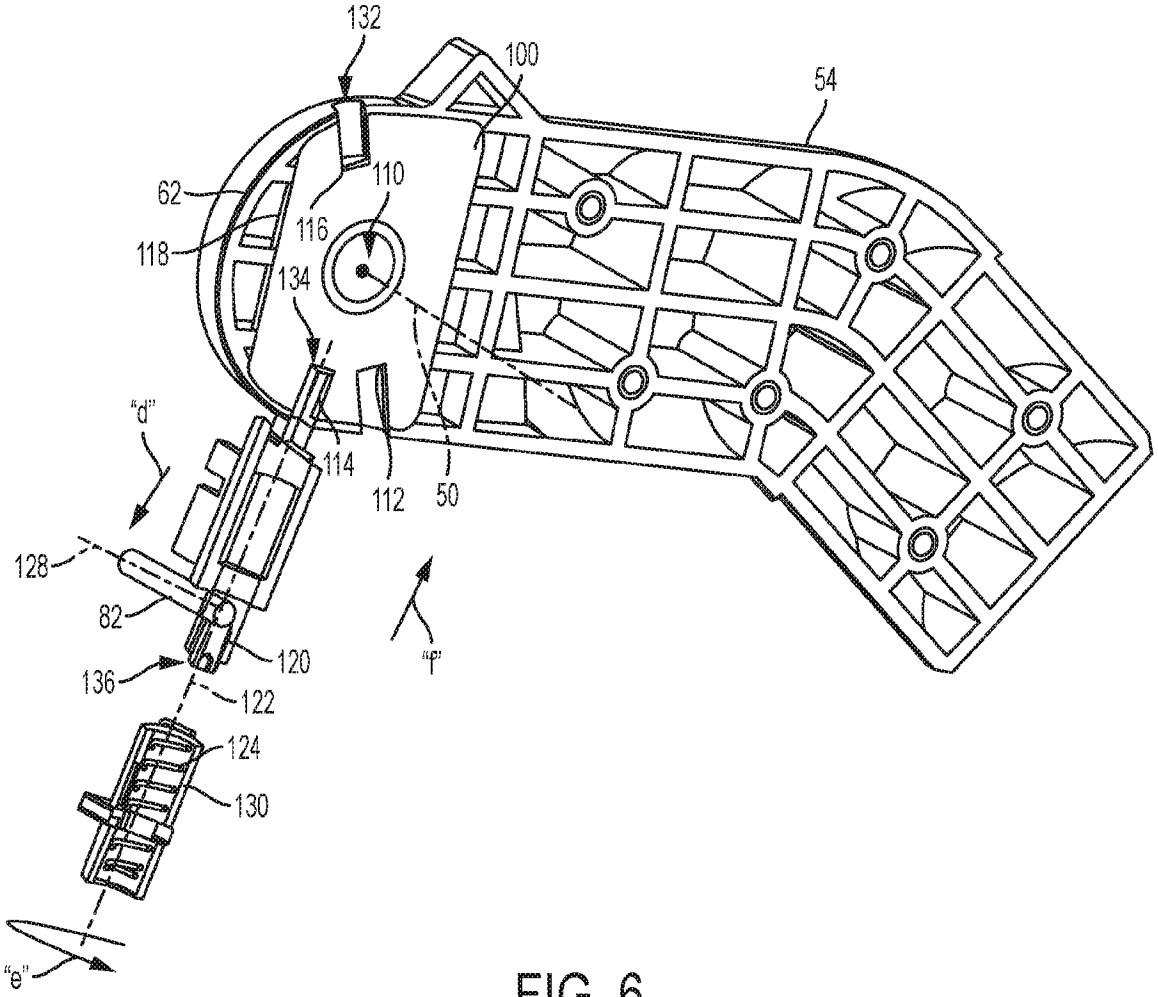
FIG. 6 is a detailed view of the hinge mechanism of FIG. 5 with certain components of the first hinge member removed from view to show certain details of the hinge mechanism.

Referring now to FIG. 6, in some embodiments, the foldable ladder 10 comprises a locking pin 120 connected to the selector pin 82. The locking pin 120 has an elongate body disposed about a central axis 122 of the locking pin 120. As illustrated in FIG. 6, the locking pin 120 moves in a direction along its central axis 122 into and out of a recess (112, 114, 116) and is receivable by a recess (112, 114, 116) of the locking plate 100. For instance, the locking pin 120 is received by a first recess 112 to lock the first and second angular portions at a first angle 60 (e.g., 0 degrees), at a second recess 114 to lock the first and second angular portions at a second angle 60 (e.g., 30 degrees) and at a third recess 116 to lock the first and second angular portions at a third angle 60 (e.g., 180 degrees). As described above, the locking plate 100 can have any number of recesses 112, 114, 116 and accordingly the first and second ladder portions 14, 16 can be lockable in corresponding number of angular positions. Referring back to FIG. 5, the locking pin 120 is received in the second recess 114. Correspondingly, the selector pin 82 is received in the second slot 76. The angle between the first and second ladder portions is about 30 degrees in the embodiment illustrated in FIG. 5. Other angular positions are contemplated. For instance, when the first and second ladder portions are locked at an angle 60 of about zero degrees, the locking pin 120 is fully received in the first recess 112, and the selector pin 82 is fully received in the slot 74. When the first and second ladder portions are locked at an angle 60 of about 180 degrees, the locking pin 120 is fully received in the third recess 116, and the selector pin 82 is fully received in the slot 78.

Figure 7:
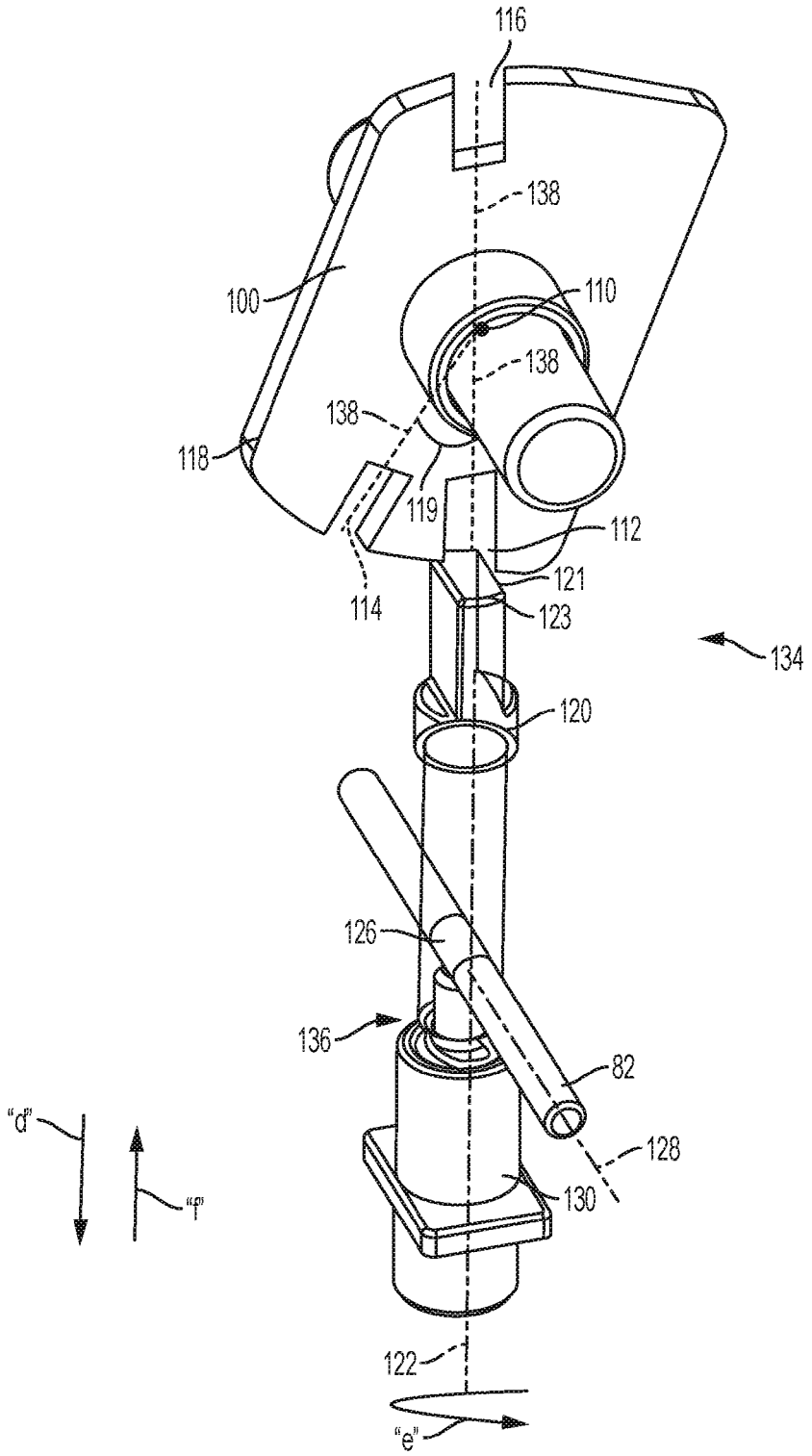
FIG. 7 is a detailed perspective view of a locking pin, a locking plate, a selector pin and a biasing spring according to an embodiment.

As shown in FIGS. 6 and 7, the locking pin 120 has a rectangular cross-section with a lengthwise edge 121 and a widthwise edge 123, although any non-circular cross-section is also contemplated. The locking pin 120 can be mounted to the first hinge member 52 for movement along its central axis 122 radially away from and towards the hinge axis 50. As will be described below, the locking pin 120 is spring-biased with a biasing spring 124 radially towards the hinge axis 50. The locking pin 120 is rotatable about its central axis 122 such that the cross-sectional shape of the locking pin 120 aligns with the shape of a recess (112, 114, 116) on the locking plate 100.

With continued reference to the embodiments illustrated in FIGS. 6 and 7, the locking pin 120 has an aperture 126 in which the selector pin 82 is received. The locking pin 120 and the selector pin 82 are therefore coupled such that they move in a cooperative manner as will be described below. In the illustrated embodiments, the locking pin 120 and the selector pin 82 are coupled such that the central axis 122 of the locking pin 120 is transversely located at an angle 60 (e.g., 90 degrees) with respect to the axis 128 of the selector pin 82. Other angles between the axis of the locking pin 120 and the selector pin 82 are also contemplated. Referring back to FIG. 5 and with continued reference to FIG. 6, the selector pin 82 and the locking pin 120 can be coupled to each other such that the locking pin 120 moves into a recess (112, 114, 116) of the locking pin 120 when the selector pin 82 moves into a slot 74, 76, 78 of the shift pattern 72. Additionally, the coupling between the selector pin 82 and the locking pin 120 can be such that the locking pin 120 moves away from a recess (112, 114, 116) of the locking plate 100 when the selector pin 82 moves away from a slot 74, 76, 78 of the shift pattern 72. While FIGS. 5 and 6 illustrate the locking pin 120 in a position where it is received by a recess (112, 114, 116) of the locking plate 100, FIG. 7 illustrates the locking pin 120 in a position where it is retracted away from the recess of the locking plate 100. As seen in FIG. 7, the locking pin 120 can be spring-biased with the biasing spring 124 radially toward the hinge axis 50. When it is fully retracted away from the recess of the locking plate 100, the locking pin 120 can abut against a seat 130 when the locking pin 120 is retracted away from a recess (112, 114, 116) of the locking plate 100. As described previously, the first ladder portion 14 and the second ladder portion 16 are rotatable with respect to each other about the hinge axis 50. The rotation of the first ladder portion 14 and second ladder portion 16 with respect to each other can position the locking pin 120 proximal to a recess (e.g., at a ladder angle opening 132). Once the angle 60 between the first and second ladder portions 14, 16 is adjusted to correspond to the angle 119 between any two of the recesses (112, 114, 116) of the locking plate 100, the locking pin 120 is brought proximal to a recess (112, 114, 116), and extends into the recess due to the spring action from a spring housed in the seat 130.

As described previously, the engagement between the locking pin 120 and the selector pin 82 allows the locking pin 120 to be received fully into a recess (e.g., second recess 114 shown in FIG. 5) to lock the first ladder portion 14 and the second ladder portion 16 in an angular position and fully retract from a recess (112, 114, 116) to release the first and second ladder portions 14, 16 from an angular position. When the locking pin 120 is fully received in the recess, the entire length of the recess is occupied by at least a first end 134 of the locking pin 120, as seen in FIGS. 5 and 6. In this position, the selector pin 82 is received in a slot 74, 76, 78 (e.g., second slot 76 as shown in FIG. 5) such that the selector pin 82 rests in the first end 84 of the slot 74, 76, 78. In the fully received position, the first and second ladder portions 14, 16 are locked with respect to each other and an angle 60 between them is fixed. When the locking pin 120 is fully released from the recess (e.g., second recess 114, as shown in FIG. 7), a second end 136 of the locking pin 120 is seated against the seat 130. In the fully released position, the first end 134 of the locking pin 120 retracts almost entirely from the recess. Correspondingly, the selector pin 82 moves to the second end 86 of the slot 74, 76, 78 (e.g., second slot 76 best seen in FIG. 5). In the fully released position, the first and second ladder portions 14, 16 are rotatable and an angle 60 between them can be changed. Prior to changing the angle 60 between the first and second ladder portions 14, 16, the selector pin 82 can be positioned proximal to another slot 74, 76, 78 (e.g., first slot 74 or third slot 78 shown in FIG. 5). When the first and second ladder portions 14, 16 are rotated to a desired angular position, the locking pin 120 is received by another recess (e.g., first or third recess 112, 116) and the selector pin 82 is received by the first end 84 of another slot 74, 76, 78 (e.g., first or third slot 78).

Figure 8A:
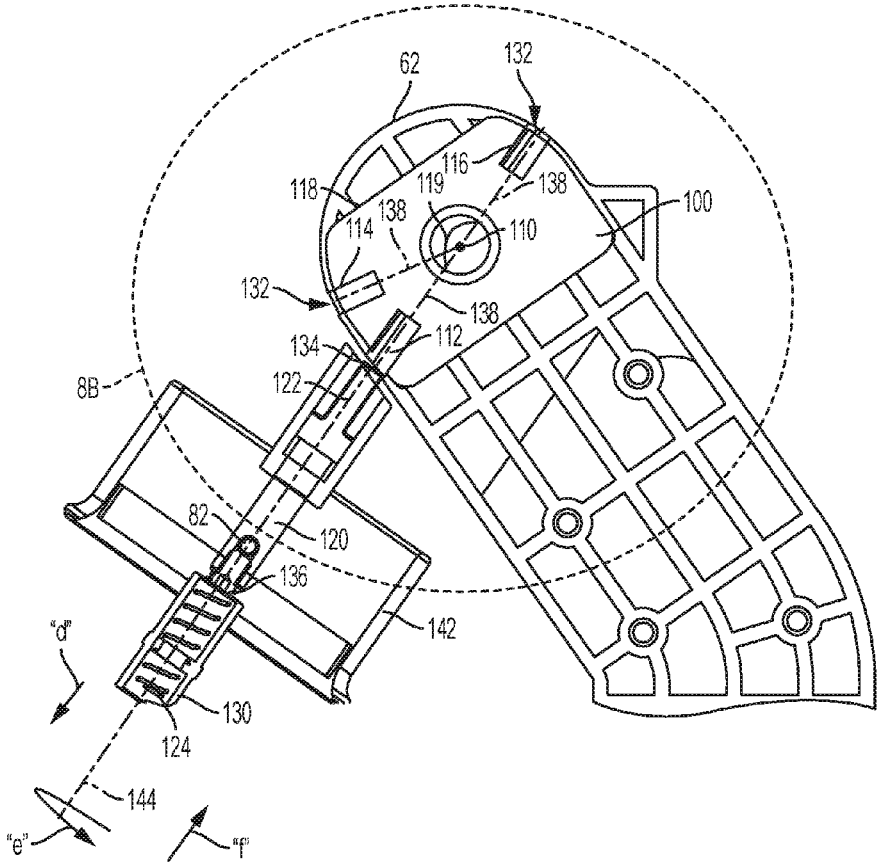
FIG. 8A is a cross-sectional side view of the hinge mechanism of FIG. 5 with certain features removed from view for showing certain details of the hinge mechanism.
Figure 8B:
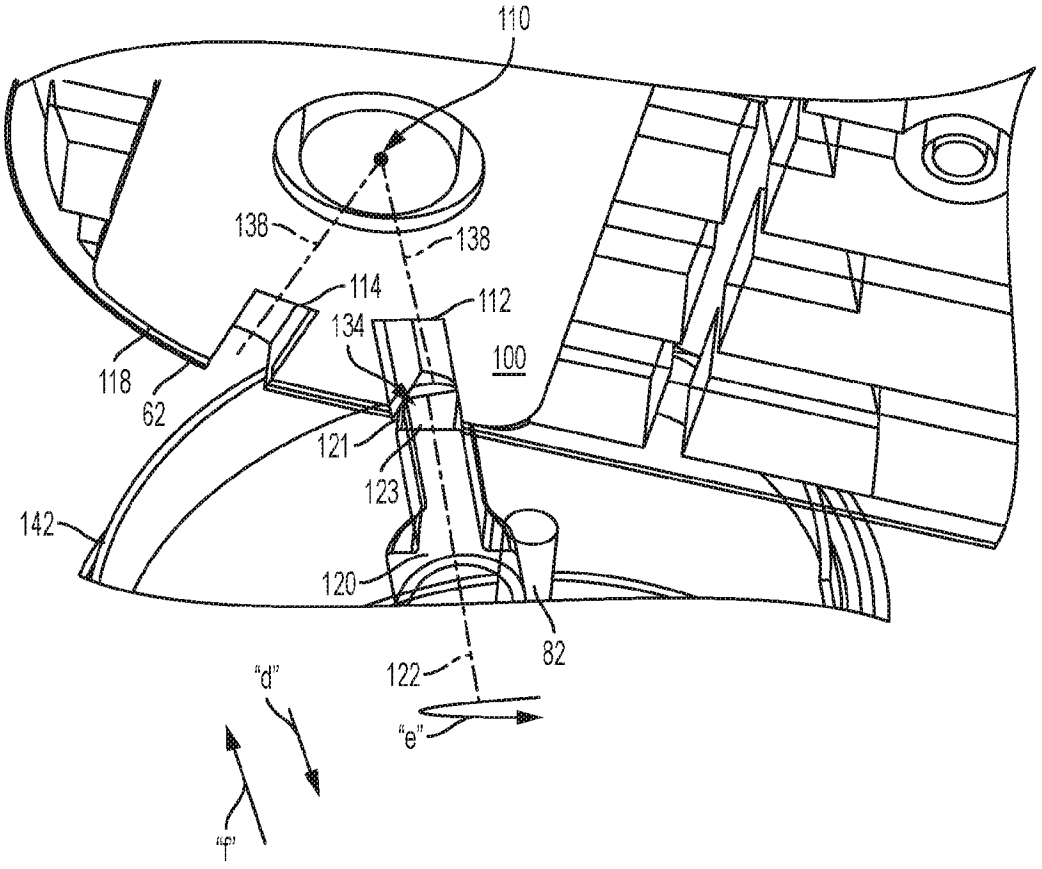
FIG. 8B is a close-up view of portion 8B of FIG. 8A.

Referring now to FIGS. 8A and 8B, the locking pin 120 can be shaped and oriented such that the locking pin 120 abuts against the edge 62 of the second hinge member 54 when the first and second ladder portions 14, 16 are angled at any angle 60 other than a plurality of predetermined angles. As seen from the close up view of FIG. 8B, each recess has a corresponding ladder angle opening 132 defined in the edge 62 of the second hinge member 54. Each ladder angle opening 132 has an opening shape. The opening shape can permit insertion of the locking pin 120 therethrough when the locking pin 120 is rotated about its central axis 122 to a rotation where the orientation of the locking pin 120 cross-section generally matches the opening shape as (e.g., as shown in FIGS. 5 and 6). As seen in FIGS. 8A and 8B, the opening shape of a ladder angle opening 132 can block insertion of the locking pin 120 therethrough when locking pin 120 is rotated about its central axis 122 to a rotation where the orientation of the locking pin 120 cross-section does not generally match the opening shape. As shown in FIGS. 8A and 8B, the locking pin is rotated such that the lengthwise edge 121 and the widthwise edge 123 do not match the opening shape of the ladder angle opening 132 of the recess 112, thereby preventing the passage of the locking pin 120 into the recess 112. In the illustrated embodiment, each recess is disposed radially inwardly along a radial line 138 toward the hinge axis 50. When the locking plate 100 is positioned concentrically with the hinge axis 50, the center 110 of the locking plate coincides with the intersecting point of the radial lines 138. The recesses 112, 114, 116 are rectangular, and the ladder angle opening shapes allow passage of the locking pin 120 having a rectangular cross-section oriented such that the central axis 122 of the locking pin 120 is inline with a radial line 138 of the recess, and the locking pin 120 rotated about its central axis 122 such that the cross-section of the locking pin 120 aligns with the opening shape of the ladder angle opening 132.

Referring back to FIGS. 5 and 6, the locking pin 120 is rotatable about its central axis 122 by a selection collar 142. As described above, each recess has a ladder angle opening 132 that allow passage of the locking pin 120 therethrough when the locking pin 120 is rotated about its central axis 122 so as to match the opening shape. In such cases, the ladder angle selector permits manual selection of the desired angle 60 between the first and second ladder portions 14, 16. In some embodiments, the ladder angle selector is a selection collar 142 slidingly engaging with the first hinge member 52. The selection collar 142 rigidly engages with the selector pin 82. In turn, the selector pin 82 engages rigidly with the locking pin 120, thereby allowing the selection collar 142 to manipulate the movement and rotation of the locking pin 120. For instance as shown in FIG. 5, the selection collar 142 can slide against the first hinge member 52 along a collar axis 144 along a direction illustrated by the arrow "d" defined generally parallel to the collar axis 144 and the central axis 122 of the locking pin 120. As the selection collar 142 slides along the direction "d", the selector pin 82 moves along with the selection collar 142 and out of the second slot 76 in the direction "d" toward the second end 86 of the second slot 76 (best illustrated in FIG. 4C). In turn, referring back to FIG. 5, the locking pin 120 moves along the direction "d" parallel to its central axis 122, and radially outwardly from the second recess 114. When the selector pin 82 rests against the second end 86 of the second slot 76, the second end 136 of the locking pin 120 abuts against the seat 130 (best seen in FIG. 7).

Referring back to FIGS. 4A-4C and 5, when the selection collar 142 moves in a direction "d" such that the selector pin 82 moves to the second end 86 of the second slot 76, the first and second ladder portions 14, 16 are not locked in an angular position. Accordingly, as described above, the second region 98 previously hidden under the selection collar 142 when the first and second ladder portions 14, 16 were locked becomes visible to the user to indicate that the first and second ladder portions 14, 16 are not locked securely. Once the angle 60 between the first and second ladder portions 14, 16 are adjusted to the desired angle the locking pin 120 moves along direction "f" due to it being spring biased toward the hinge axis 50. The direction "d" can be opposite to direction "f". The selector pin 82 moves along direction "f" and proximal to the first end 84 of the second slot 76. During this movement, the selection collar 142 also moves along direction "f" due to the rigid coupling between the selection collar 142, the locking pin 120 and the selector pin 82. The locking pin 120 is received in a recess (112, 114 or 116) and the selector pin 82 is received in a slot 74, 76, 78, thereby preventing any relative rotational motion about the hinge axis 50 between the first and second hinge members 52, 54 and the first and second ladder portions 14, 16 connected thereto. As the selection collar 142 moves along the direction "f", the first region 96 previously hidden under the selection collar 142 when the first and second ladder portions 14, 16 were unlocked, becomes visible to the user to indicate that the first and second ladder portions 14, 16 are securely locked.

With continued reference to FIGS. 4A-4C and FIG. 5, the selection collar 142 can be rotatable about the collar axis 144 with respect to the first hinge member 52. As the selection collar 142 is rotated (e.g., along the direction "e" about the collar axis 144 illustrated in FIG. 5), the selector pin 82 moves along the shift pattern 72 defined on the first hinge member 52. For instance, the selection collar 142 can be moved until the selection pin moves adjacent to the third slot 78. As the selection collar 142 rotates about the collar axis 144 with respect to the first hinge member 52, the rigid coupling between the selector pin 82 and the locking pin 120 transmits the rotational motion of the selection collar 142 and rotates the locking pin 120 about its central axis 122. When the selection collar 142 rotates sufficiently to bring the selector pin 82 proximal to the third slot 78 (e.g., at the second end 86 of the third slot 78), the locking pin 120 is rotated about its central axis 122 such that its cross-section matches the opening shape of the third recess 116. Such manual manipulation can allow a user to manually select the desired angle 60 out of a plurality of predetermined angles between the first and second ladder portions 14, 16.

In use, a user can unfold a ladder 10 from its angular position during storage (e.g., the first and second ladder portions 14, 16 forming an angle 60 of about 0 degrees as illustrated in FIG. 1A). Referring to FIGS. 4A-4C, the user can shift the selection collar 142 along a direction "d" and rotate the selection collar 142 in a direction "e" until the selection pin is proximal to the second end 86 of another slot 74, 76, 78. The rotational motion of the selection collar 142 rotates the locking pin 120 about its central axis 122 such that the cross-section of the locking pin 120 matches a ladder angle opening 132 of a recess (112, 114, 116). The user can then rotate first and second ladder portions 14, 16 with respect to each other to the desired angle 60 (chosen from predetermined angles at which the first and second ladder portions 14, 16 can be locked). Once the desired angle 60 is reached, the locking pin 120 is automatically pushed into a recess (112, 114 or 116) because the locking pin 120 is spring-biased toward the hinge axis 50 along a direction "f". The selector pin 82 and the selection collar 142 are also move along the direction "f". The first and second ladder portions 14, 16 are locked in the desired angular position, and the selector pin 82 rests in the first end 84 of a slot 74, 76, 78 corresponding to the desired angular position. The first and second ladder portions 14, 16 may not be further rotated until the locking pin 120 is released from the recess (112, 114 or 116) by moving the selection collar 142 along the direction "d" and repeating the steps described above.

Embodiments of the foldable ladder described herein can allow a user to fold a ladder for storage to minimize footprint and unfold it and lock it securely in a plurality of angles. Embodiments of the foldable ladder described herein are safe and easy to use.

Thus, embodiments of the foldable ladder are disclosed. Although the present embodiments has been described in considerable detail with reference to certain disclosed embodiments, the disclosed embodiments are presented for purposes of illustration and not limitation and other embodiments are possible. One skilled in the art will appreciate that various changes, adaptations, and modifications may be made without departing from the spirit of the invention.

What is claimed is:

1. A foldable ladder, comprising:

a first ladder portion;

a second ladder portion hingedly attached to the first ladder portion, each of the first and second ladder portions comprising a first stile, a second stile, the first and second stiles each having a plurality of columns disposed along an axis of the plurality of columns, and a plurality of rungs extending between the first stile and the second stile, each rung connected to a column of the plurality of columns of the first stile and a column of the plurality of columns of the second stile; and a pair of hinge mechanisms hingedly connecting the first ladder portion to the second ladder portion about a hinge axis such that the first ladder portion and the second ladder portion are rotatable about the hinge axis, each hinge mechanism adapted to lock the first and second ladder portions such that the first ladder portion and the second ladder portion form an angle therebetween, each hinge mechanism comprising, a first hinge member operably connected to the first ladder portion, a second hinge member operably connected to the second ladder portion, the first and second hinge members rotatable with respect to each other about the hinge axis, a locking pin being elongate and terminating in an end having a non-circular cross-section, the locking pin having a central axis passing through the end having the non-circular cross-section, the central axis of the locking pin being non-aligned with the hinge axis, the locking pin mounted to the first hinge member for movement along the central axis of the locking pin radially away from and towards the hinge axis, the locking pin being spring biased radially towards the hinge axis, the locking pin being rotatable about the central axis of the locking pin by a ladder angle selector, the ladder angle selector permitting manual selection of the desired angle between the first and second ladder portions, a plurality of recesses each directed radially inward towards the hinge axis from the end of the second hinge member, the plurality of recesses spaced angularly about the hinge axis, an angular position about the hinge axis of each recess corresponding to a predetermined angle between the first and second ladder portions, each recess having a corresponding ladder angle opening defined on the end of the second hinge member, each ladder angle opening having an opening shape, the opening shape being configured to permit insertion of the locking pin therethrough when the locking pin is rotated about the central axis of the locking pin to a rotation where the orientation of the locking pin cross-section generally matches the opening shape, the opening shape being configured to block insertion of the locking pin therethrough when the locking pin is rotated about the central axis of the locking pin to a rotation where the orientation of the locking pin cross-section does not generally match the opening shape.

2. The foldable ladder of claim 1, wherein the first ladder portion and the second ladder portion are rotatable with respect to each other about the hinge axis, the rotation of the first ladder portion and second ladder portion with respect to each other adapted to position the locking pin proximal to the corresponding ladder angle opening.

3. The foldable ladder of claim 1, wherein, the plurality of rungs comprises a first rung connected to the column of the plurality of columns of the first stile by a first connector assembly, the first rung being connected to the column of the plurality of columns of the second stile by a second connector assembly, the first connector assembly and the second connector assembly each having a first release button and a second release button, the first release button being slidable along a first surface of the first rung, the second release button being slidable along a second surface of the first rung, the sliding of the first release button and/or the second release button permitting unlocking or selectively locking a relative axial movement between two adjacent columns of the plurality of columns.

4. The foldable ladder of claim 3, wherein the first and second release buttons are coupled to a rung pin and a spring, the spring exerting a biasing force against the rung pin to engage the rung pin with two adjacent columns of the plurality of columns to selectively lock relative axial movement between the two adjacent columns, the sliding motion of either of the first and second release buttons along the respective front or back surfaces retracting the rung pin to unlock the two adjacent columns and thereby permit relative axial movement therebetween.

5. The foldable ladder of claim 4, wherein sliding of one of the first release button or the second release button results in sliding of the other of the first release button or the second release button by virtue of a frictional engagement between the first release button, the second release button and the rung pin.

6. The foldable ladder of claim 5, wherein the rung pin comprises a pair of holes, and the first release button and the second release button each comprises a shank, each shank being insertable into one of the holes of the pair of holes.

7. The foldable ladder of claim 3, wherein the first surface and the second surface are each generally perpendicular to a planar standing surface of the first rung.

8. The foldable ladder of claim 7, wherein the planar standing surface is a top surface of the first rung if the first rung is located in the first ladder portion.

9. The foldable ladder of claim 8, wherein, if the first rung is located in the second ladder portion, when the angle between the first ladder portion and the second ladder portion is less than about 90 degrees, the planar standing surface is a bottom surface of the first rung, and when the angle between the first ladder portion and the second ladder portion is about 180 degrees, the planar standing surface is the top surface of the first rung of the second ladder portion.

10. The foldable ladder of claim 3, wherein one or more rungs of the first ladder portion and/or the second ladder portion comprises an angled portion forming an angle of between about 5 degrees and about 45 degrees with respect to a horizontal plane, the angled portion being generally horizontal when the ladder is rotated towards a vertical wall.

11. The foldable ladder of claim 1, wherein the central axis of the locking pin is non-parallel to the hinge axis.

12. The foldable ladder of claim 1, wherein the central axis of the locking pin is generally perpendicular to the hinge axis.

13. The foldable ladder of claim 1, wherein the central axis of the locking pin passes through a recess of the plurality of recesses that receives the locking pin when the locking pin is rotated about the central axis of the locking pin to a rotation where the orientation of the locking pin cross-section generally matches the opening shape.

14. A foldable ladder, comprising:

a first ladder portion;

a second ladder portion hingedly attached to the first ladder portion, each of the first and second ladder portions comprising a first stile, a second stile, the first and second stiles each having a plurality of columns disposed along an axis of the plurality of columns, and a plurality of rungs extending between the first stile and the second stile, each rung connected to a column of the plurality of columns of the first stile and a column of the plurality of columns of the second stile; and a pair of hinge mechanisms hingedly connecting the first ladder portion to the second ladder portion about a hinge axis such that the first ladder portion and the second ladder portion are rotatable about the hinge axis, each hinge mechanism adapted to lock the first and second ladder portions such that the first ladder portion and the second ladder portion form an angle therebetween, each hinge mechanism comprising, a first hinge member operably connected to the first ladder portion, a second hinge member operably connected to the second ladder portion, the first and second hinge members rotatable with respect to each other about the hinge axis, the second hinge member having an end, a locking pin being elongate and terminating in an end having a non-circular cross-section having a first edge and a second edge, the locking pin having a central axis passing through the end having the non-circular cross-section, the central axis of the locking pin being non-coaxial with the hinge axis, the locking pin mounted to the first hinge member for movement along the central axis of the locking pin radially away from and towards the hinge axis, the locking pin being spring biased radially towards the hinge axis, the locking pin being rotatable about the central axis of the locking pin by a ladder angle selector, the ladder angle selector permitting manual selection of the desired angle between the first and second ladder portions, a plurality of recesses each directed radially inward towards the hinge axis from the end of the second hinge member, the plurality of recesses spaced angularly about the hinge axis, an angular position about the hinge axis of each recess corresponding to a predetermined angle between the first and second ladder portions, each recess having a corresponding ladder angle opening defined on the end of the second hinge member, each ladder opening having an opening shape so as to permit insertion of the locking pin therethrough only when the locking pin is rotated about the central axis of the locking pin to a rotation where the first edge and the second edge of the locking pin is in line with the corresponding ladder angle opening.

15. The foldable ladder of claim 14, wherein the end of the locking pin has a rectangular cross-section.

16. The foldable ladder of claim 15, wherein the first edge is of a length less than the second edge.

17. The foldable ladder of claim 14, wherein the central axis of the locking pin is non-parallel to the hinge axis.

18. The foldable ladder of claim 14, wherein the central axis of the locking pin is generally perpendicular to the hinge axis.

19. The foldable ladder of claim 14, wherein the central axis of the locking pin passes through a recess of the plurality of recesses that receives the locking pin when the locking pin is rotated about the central axis of the locking pin to a rotation where the orientation of the locking pin cross-section generally matches the opening shape.

* * * * *